US007534556B2

(12) United States Patent
Yokouchi

(10) Patent No.: US 7,534,556 B2
(45) Date of Patent: May 19, 2009

(54) METHOD OF MANUFACTURING NOZZLE PLATE, LIQUID DROPLET EJECTION HEAD AND IMAGE FORMING APPARATUS

(75) Inventor: Tsutomu Yokouchi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 348 days.

(21) Appl. No.: 11/330,254

(22) Filed: Jan. 12, 2006

(65) Prior Publication Data

US 2006/0156546 A1 Jul. 20, 2006

(30) Foreign Application Priority Data

Jan. 14, 2005 (JP) ..... 2005-008141

(51) Int. Cl.
*B41J 2/16* (2006.01)

(52) U.S. Cl. ..... 430/320; 29/890.1; 29/890.142

(58) Field of Classification Search ..... None
See application file for complete search history.

(56) References Cited

U.S. PATENT DOCUMENTS 6,179,978 B1 * 1/2001 Hirsh et al. ..... 204/281

FOREIGN PATENT DOCUMENTS

JP 10-296982 A 11/1998

* cited by examiner

*Primary Examiner*—John A. McPherson
(74) *Attorney, Agent, or Firm*—Birch, Stewart, Kolasch & Birch, LLP

(57) ABSTRACT

The method of manufacturing a nozzle plate formed with nozzles which eject liquid droplets, the method comprises the steps of: forming and patterning an opaque metal film onto a transparent substrate; forming photosensitive resin over the opaque metal film and the transparent substrate; exposing the photosensitive resin to light from a side adjacent to the transparent substrate; developing the photosensitive resin which has been exposed to the light; forming a metal layer on the opaque metal film after the developing step; and separating at least the transparent substrate from the metal layer, wherein the nozzle plate comprises at least the metal layer, and a liquid droplet ejection surface of the nozzle plate is on a side where the transparent substrate has been separated in the separating step.

11 Claims, 11 Drawing Sheets

METHOD OF MANUFACTURING NOZZLE PLATE, LIQUID DROPLET EJECTION HEAD AND IMAGE FORMING APPARATUS

BACKGROUND OF THE INVENTION

1. Field of the Invention

The present invention relates to a method of manufacturing a nozzle plate, a liquid droplet ejection head and an image forming apparatus, and more particularly to a method of manufacturing a nozzle plate in which nozzles for ejecting droplets of liquid are formed.

2. Description of the Related Art

The print head of an inkjet type image forming apparatus has a plurality of nozzles formed in a nozzle plate, which constitutes an ejection surface that opposes the recording medium. The shape of the nozzles which eject ink droplets onto the recording medium readily affects the size and the ejection speed, and the like, of the ink droplets, and therefore, the nozzles must be processed to a high degree of accuracy.

A processing method using electroforming (hereinafter referred to as "electroforming method") is known as a method of manufacturing a nozzle plate of this kind. A characteristic feature of the electroforming method is that it allows nozzle plates to be manufactured at low cost, compared to a processing method using a laser beam or a processing method using a press.

FIGS. 11A to 11C show a first related method of manufacturing a nozzle plate based on an electroforming method in the related art. Firstly, as shown in FIG. 11A, a photosensitive resin (hereinafter referred to as "resist") 202 which is photocurable is formed and patterned on a metal substrate 200. The plan shape of the resist 202 is circular, and the center thereof substantially coincides with the center of a nozzle to be formed. Next, as shown in FIG. 11B, a metal layer 204 of nickel plating, or the like, for example, is grown and formed on the metal substrate 200 by means of an electroforming method. When the thickness of the metal layer 204 exceeds the thickness of the resist 202, the metal layer 204 is grown in such a manner that the metal layer 204 gradually covers the resist 202 from the periphery thereof. Then, a recess portion 206 having an internal wall with a curved cross-sectional shape is formed. In other words, the metal layer 204 is formed to overhang the resist 202. Finally, as shown in FIG. 11C, the metal substrate 200 and the resist 202 are peeled away from the metal layer 204, and the metal layer 204 corresponding to a nozzle plate 260 is thus obtained. Nozzles (through holes) 251 each having a curved cross-section corresponding to the recess portions 206 in FIG. 11B are formed in the nozzle plate 260.

FIGS. 12A and 12B show a second related method of manufacturing a nozzle plate based on an electroforming method in the related art. Firstly, a patterned resist 302 is formed in a substantially circular cylinder shape on a metal substrate 300, and a metal layer 304 is grown on the metal substrate 300 to a height lower than the height of the resist 302, as shown in FIG. 12A. Then, the metal substrate 300 and the resist 302 are peeled away from the metal layer 304, and the metal layer 304 corresponding to a nozzle plate 360 is thus obtained, as shown in FIG. 12B. Nozzles 351 each having an inner wall with a substantially linear shaped cross-section (straight shape) are formed in the nozzle plate 360.

Japanese Patent Application Publication No. 10-296982 discloses a third related method of manufacturing a nozzle plate based on an electroforming method. Firstly, an opaque metal film is patterned onto a transparent substrate, and a photosensitive resist layer having a thickness of 100 μm made of a photocurable resin is formed on the opaque metal film. Thereupon, the resist layer is exposed to light via the opaque metal film from the side of the transparent substrate. In this exposure process, the amount of exposure light received by the resist layer is adjusted in such a manner that a strong exposure is achieved on the transparent substrate side, and the amount of exposure light declines as it moves toward the opposite side from the transparent substrate. The development processing is carried out subsequently, and a sharp end-shaped (tapered) resist which narrows in the direction of irradiation is formed. Then, a metal layer is formed on the opaque metal film and the metal layer is then separated from the transparent substrate and the resist, and the metal layer corresponding to a nozzle plate is thus obtained. The surface of the nozzle plate corresponding to the ink droplet ejection side (ink ejection surface) is the surface of the metal layer opposite to the transparent substrate.

However, there are the following problems in the methods of manufacturing the nozzle plate based on the electroforming method in the related art.

In the first related method of manufacture, as shown in FIG. 11C, the nozzles 251 having a curved cross-section on the inner walls have to be arranged at a certain interval with respect to the adjacent nozzles in accordance with their shape, and hence there are limitations on the degree to which the density of the nozzles can be raised. Furthermore, the diameter W of the nozzles 251 is uneven due to variation in the metal layer 204 formed to a thickness greater than that of the resist 202 by electroforming, and there is a problem in that this unevenness is liable to affect the size and flight characteristics, such as the ejection speed, of the ink droplets ejected from the nozzles 251.

In the second related method of manufacture, when the patterned resist 302 is formed on the metal substrate 300, as shown in FIG. 13A, an unpatterned resist layer 306 is formed on the metal substrate 300 and the resist layer 306 is then exposed to light from the upper side. More specifically, ultraviolet light 310 is irradiated onto the resist layer 306 via a mask 308 formed with apertures 308*a* corresponding to the prescribed nozzle shape. In this exposure process, a portion of the ultraviolet light 310 irradiated onto the resist layer 306 may be dispersed, and it may be reflected by the metal substrate 300 on the under side of the resist layer 306. When the developing process is carried out in this case, a resist 306*a* on the side adjacent to the metal substrate 300 assumes a broadened shape as shown in FIG. 13B, rather than a straight shape such as the resist 302 shown in FIG. 12A. There is a decline in the dimensional accuracy of the nozzles formed in this case, and the flight characteristics of the ink droplets ejected from the nozzles deteriorate.

In the third related method of manufacture, light exposure is carried out by adjusting the amount of light irradiated onto a 100 μm-thick resist layer, in such a manner that the light intensity is lower on the side opposite to the transparent substrate than it is on the side adjacent to the transparent substrate. Hence, there is slight variation in the amount of exposure light, as well as slight variation during developing, which adversely affect the dimensional accuracy of the resist formed into a tapered shape, leading to poor accuracy in the overall dimensions of the nozzles.

Furthermore, the dimensional accuracy of the resist is generally good on the base side; however, in the third related method of manufacture, the surface forming the ink droplet ejection surface of the nozzle plate is the surface on the opposite side to the transparent substrate, which corresponds to the base. Thus, the ink droplet ejection sides of the nozzles are formed on the basis of the resist shape that has inferior dimensional accuracy compared to the opposite side (the side of the transparent substrate). Therefore, there is a problem in that the dimensional accuracy of the nozzles on the ink droplet ejection side is not good, and this poor accuracy is liable to affect the ejection volume and the flight characteristics, such as the ejection speed, of the ink droplets ejected from the nozzles.

SUMMARY OF THE INVENTION

The present invention has been contrived in view of the foregoing circumstances, and provides a method of manufacturing a nozzle plate, a liquid droplet ejection head, and an image forming apparatus which improve the dimensional accuracy of the nozzles on the droplet ejection side.

In order to attain the aforementioned object, the present invention is directed to a method of manufacturing a nozzle plate formed with nozzles which eject liquid droplets, the method comprises the steps of: forming and patterning an opaque metal film onto a transparent substrate; forming photosensitive resin over the opaque metal film and the transparent substrate; exposing the photosensitive resin to light from a side adjacent to the transparent substrate; developing the photosensitive resin which has been exposed to the light; forming a metal layer on the opaque metal film after the developing step; and separating at least the transparent substrate from the metal layer, wherein the nozzle plate comprises at least the metal layer, and a liquid droplet ejection surface of the nozzle plate is on a side where the transparent substrate has been separated in the separating step.

According to the present invention, the liquid droplet ejection surface of the nozzle plate is the surface from which the transparent substrate has been separated in the separating step, and corresponds to the side where the exposure light is incident on the photosensitive resin in the exposing step. Therefore, the dimensional accuracy of the nozzles is improved on the liquid droplet ejection side thereof, compared to a case where the liquid droplet ejection surface is on the opposite side. Accordingly, the flight characteristics, such as the ejection volume and ejection speed, of the liquid droplets ejected from the nozzles are improved.

Preferably, the exposing step comprises the step of controlling at least one of a wavelength range of the light, an amount of the light and an irradiation angle of the light to the photosensitive resin, in such a manner that the light divergently travels through the photosensitive resin. According to this, it is possible to form nozzle shapes which produce good flight characteristics, by adopting a tapered shape which narrow toward the end.

Preferably, the photosensitive resin is of 10 μm through 50 μm in thickness. If the thickness of the photosensitive resin is 10 μm through 50 μm, then the dimensional accuracy of the photosensitive resin is good on the side that is not adjacent to the transparent substrate. If the thickness of the photosensitive resin is 50 μm, then the dimensional accuracy is ±5 μm or less, and if the thickness of the photosensitive resin is 10 μm, then the dimensional accuracy is ±1 μm or less.

Preferably, the opaque metal film has liquid repellency. According to this, it is not necessary to carry out a separate liquid repelling treatment on the liquid droplet ejection surface of the nozzle plate.

Preferably, the opaque metal film is of not less than 1 μm and not more than 5 μm in thickness. According to this, straight portions are formed in the nozzles on the liquid droplet ejection side thereof, and therefore the ejection direction is stabilized.

In order to attain the aforementioned object, the present invention is also directed to a liquid droplet ejection head, comprising the nozzle plate manufactured by the above-described method.

In order to attain the aforementioned object, the present invention is also directed to an image forming apparatus, comprising the above-described liquid droplet ejection head.

According to the present invention, the liquid droplet ejection surface of the nozzle plate is the surface on the side where the transparent substrate is separated from the metal layer in the separation step, and corresponds to the side where the exposure light is incident on the photosensitive resin in the light exposure step. Therefore, the dimensional accuracy of the nozzles is improved on the liquid droplet ejection side thereof, compared to a case where the liquid droplet ejection surface is on the opposite side. Accordingly, the flight characteristics, such as the ejection volume and ejection speed, of the liquid droplets ejected from the nozzles are improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
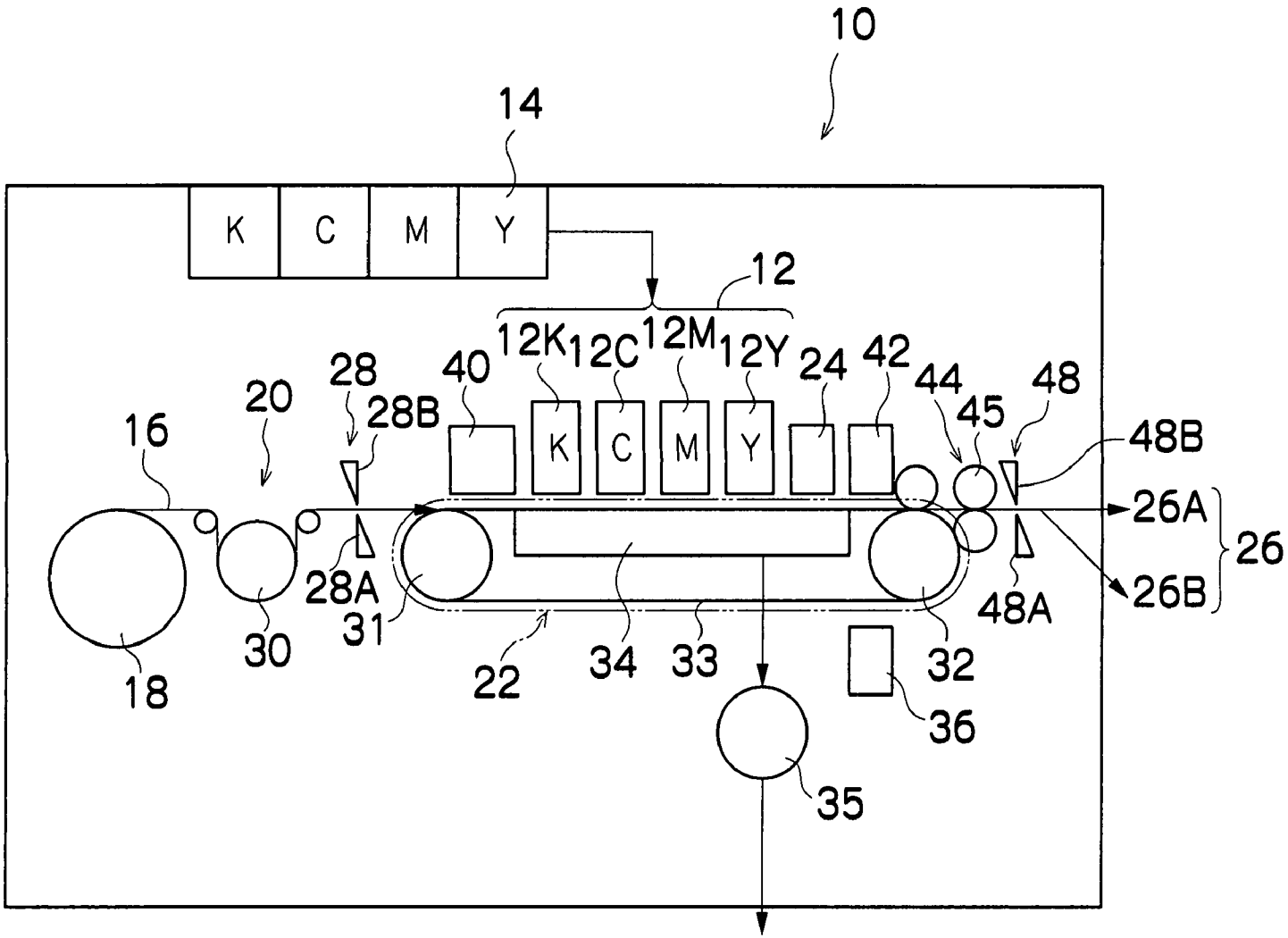
FIG. 1 is a general schematic drawing of an embodiment of an inkjet recording apparatus corresponding to an image forming apparatus according to the present invention.

FIG. 1 is a general schematic drawing of an inkjet recording apparatus corresponding to an image forming apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
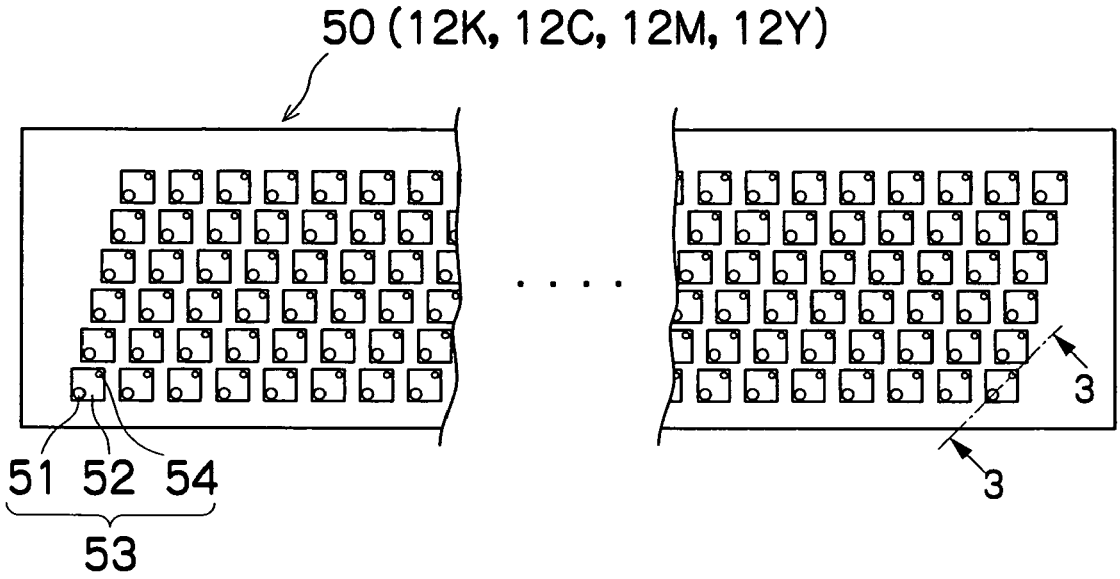
FIG. 2 is a plan perspective diagram showing an example of the structure of a print head.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, the print heads 12K, 12C, 12M and 12Y which constitute the print unit 12 each comprise line heads in which a plurality of ink ejection ports (nozzles) are arranged through a length exceeding at least one edge of the maximum size recording paper 16 intended for use with the inkjet recording apparatus 10.

The print heads 12K, 12C, 12M, and 12Y are arranged in the order of black (K), cyan (C), magenta (M), and yellow (Y) from the upstream side (left side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in a direction (main scanning direction) which is perpendicular to the paper conveyance direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor and the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Structure of the Print Head

Next, the structure of the print head will be described. The print heads 12K, 12M, 12C and 12Y of the respective ink colors have the same structure, and a reference numeral 50 is hereinafter designated to any of the print heads.

Figure 3:
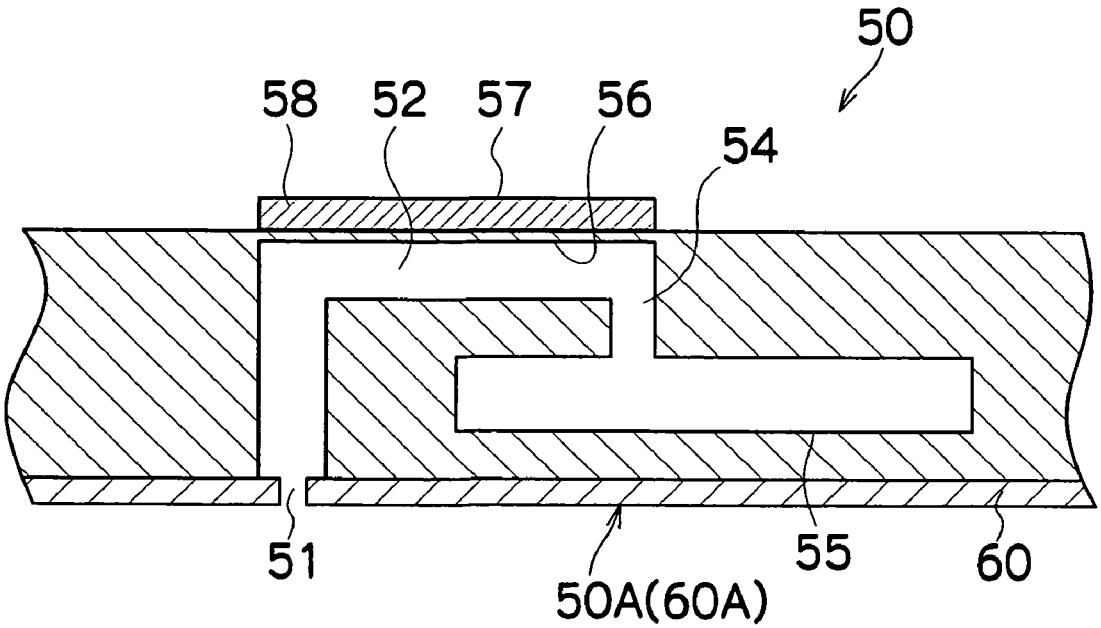
FIG. 3 is a cross-sectional diagram along line 3-3 in FIG. 2.

FIG. 2 is a plan view perspective diagram showing an example of the structure of the print head 50. FIG. 3 is a cross-sectional diagram (along line 3-3 in the FIG. 2) showing the three-dimensional composition of one of liquid droplet ejection elements (an ink chamber unit corresponding to one nozzle 51).

The nozzle pitch in the print head 50 should be minimized in order to maximize the density of the dots printed on the surface of the recording paper. As shown in FIG. 2, the print head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the print head (the direction perpendicular to the paper conveyance direction) is reduced and high nozzle density is achieved.

As shown in FIG. 2, the planar shape of the pressure chamber 52 provided for each nozzle 51 is substantially a square, and the nozzle 51 and an inlet of supplied ink (supply port) 54 are disposed in both corners on a diagonal line of the square.

As shown in FIG. 3, the nozzle plate 60 according to the present embodiment is provided on the nozzle surface (ink ejection surface) 50A of the print head 50. The nozzles 51 are formed in the nozzle plate 60. The method of manufacturing the nozzle plate 60 is described later.

Furthermore, each pressure chamber 52 is connected via a supply opening 54 to a common flow passage 55. The common flow channel 55 is connected to an ink tank (not shown), which is a base tank that supplies ink, and the ink supplied from the ink tank is delivered through the common flow channel 55 to the pressure chambers 52.

An actuator 58 provided with an individual electrode 57 is joined to a pressure plate (common electrode) 56 which forms the upper face of each pressure chamber 52, and the actuator 58 is deformed when a drive voltage is applied to the individual electrode 57 and common electrode 56 so that the volume of the pressure chamber 52 is changed, thereby causing ink to be ejected from the nozzle 51. A piezoelectric element is suitable as the actuator 58. When ink is ejected, new ink is supplied to the pressure chamber 52 from the common flow channel 55 through the supply port 54.

Figure 4:
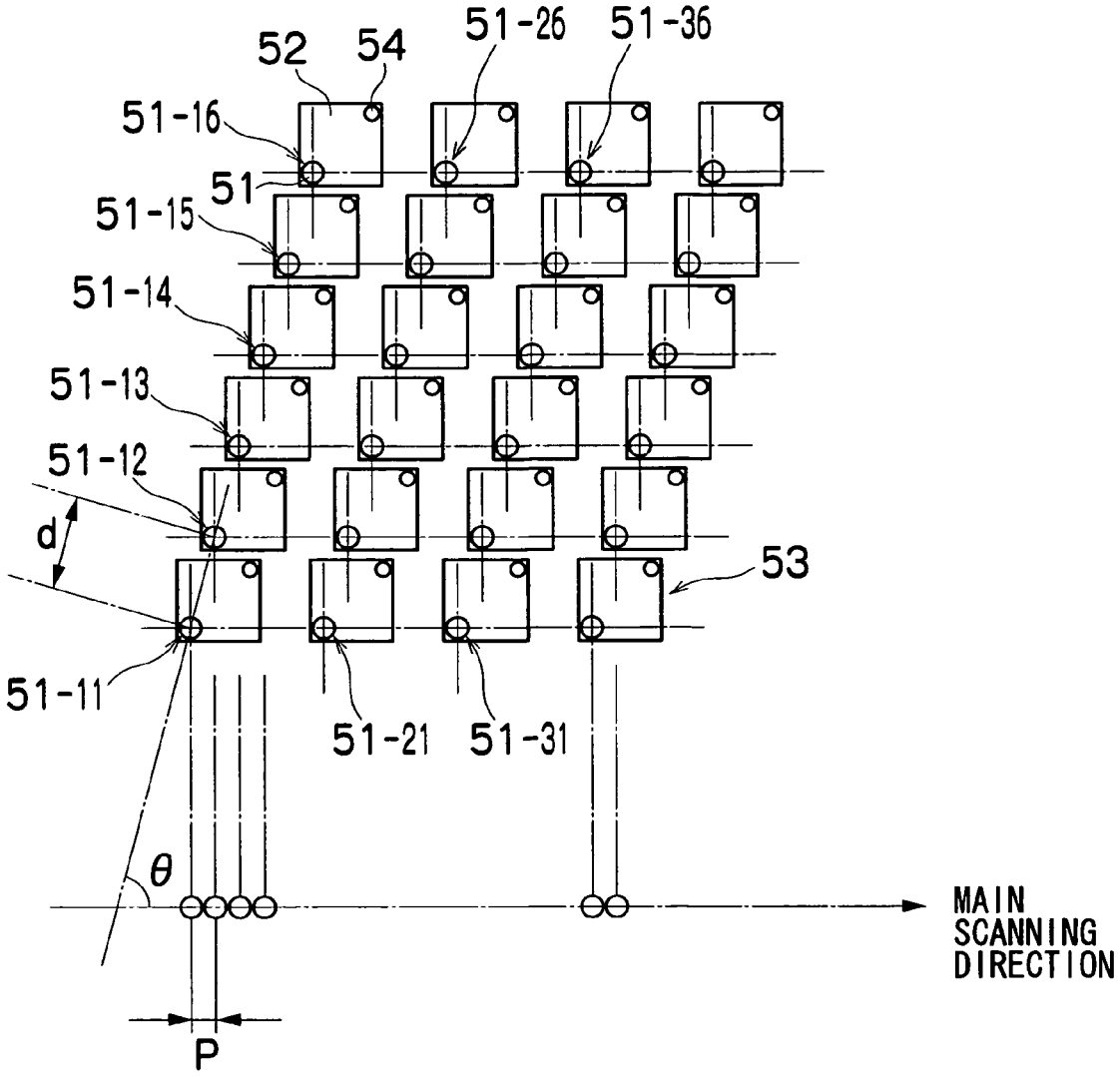
FIG. 4 is a detail diagram showing an enlarged view of a portion of the print head shown in FIG. 2.

As shown in FIG. 4, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure in which a plurality of ink chamber units 53 are arranged at a uniform pitch d in a direction having an angle $\theta$ with respect to the main scanning direction, the pitch P of the nozzles projected so as to align in the main scanning direction is $d \times \cos\theta$.

More specifically, the arrangement can be treated equivalently to one in which the nozzles 51 are arranged in a linear fashion at uniform pitch P, in the main scanning direction. By means of this composition, it is possible to achieve a nozzle composition of high density, in which the nozzle columns projected to align in the main scanning direction reach a total of 2,400 per inch (2,400 nozzles per inch).

In a full-line head comprising rows of nozzles that have a length corresponding to the entire width of the image recordable width, the "main scanning" is defined as printing one line or one strip in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 4 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 20 by sequentially driving the nozzles 51-11, 51-12, . . . , 51-16 in accordance with the conveyance velocity of the recording paper 20.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, in the present embodiment, a method is employed wherein an ink droplet is ejected by means of the deformation of the actuator 58, which is, typically, a piezoelectric element, but in implementing the present invention, the method used for ejecting ink is not limited in particular, and instead of a piezo jet method, it is also possible to apply various other types of methods, such as a thermal jet method, wherein the ink is heated and bubbles are caused to form therein, by means of a heat generating body, such as a heater, ink droplets being ejected by means of the pressure of these bubbles.

Method for Manufacturing Nozzle Plate

Next, a method of manufacturing the nozzle plate according to an embodiment of the present invention will be described.

Figure 5A:
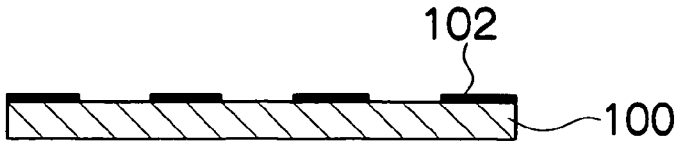
FIGS. 5A to 5F are illustrative diagrams showing steps of manufacturing a nozzle plate according to a first embodiment.

FIGS. 5A to 5F are illustrative diagrams showing steps of manufacturing a nozzle plate 60 according to the first embodiment. Firstly, in a step of forming an opaque metal film, as shown in FIG. 5A, an opaque metal film 102 which is impenetrable to ultraviolet light is formed and patterned in accordance with the nozzle shapes and the nozzle arrangement, onto a transparent substrate 100 which transmits ultraviolet light, such as a glass substrate. For the patterning method of the opaque metal film 102, a commonly known technique, such as photolithography, is used. The opaque metal film 102 is thin, having a thickness of approximately 1 μm or lower, and a dimensional accuracy of around ±0.1 μm or less.

Figure 5B:
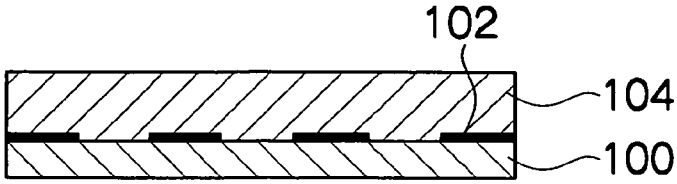

Next, in a resist layer forming step, a photosensitive and photocurable resin layer (resist layer) 104 is formed over the surface of the transparent substrate 100 on which the opaque metal film 102 has been formed as shown in FIG. 5B. In the present embodiment, the thickness of the resist layer 104 is approximately 10 μm through 50 μm.

Figure 5C:
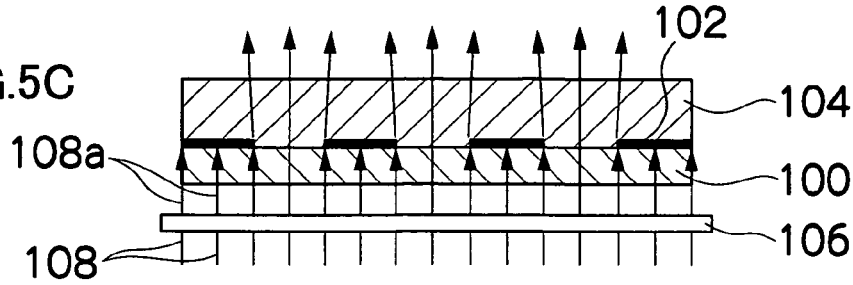

Next, in a light exposure step, as shown in FIG. 5C, ultraviolet light 108 is irradiated through a diffusion plate 106 onto the side of the transparent substrate 100 opposite to the side where the opaque metal film 102 is formed (namely, the transparent substrate side). The diffusion plate 106 has the function of converting the transmitted light into diffused light, and it comprises, for example, a combination of ground glass, and a lens system, and the like. Consequently, the ultraviolet light 108*a* transmitted by the diffusion plate 106 becomes diffused light, and travels through the transparent substrate 100. The patterned opaque metal film 102 on the transparent substrate 100 functions as a mask, and partially intercepts the ultraviolet light 108*a* in accordance with the shape of the patterning. On the other hand, the ultraviolet light 108*a* which is transmitted rather than being intercepted by the opaque metal film 102 is diffused light, and divergently travels through the resist layer 104.

Figure 5D:
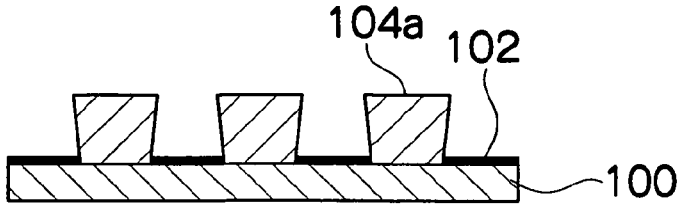

Next, in a developing step, a development process of the resist layer 104 is carried out. Since the exposed portion of the resist layer 104 on which the ultraviolet light 108*a* has been irradiated in the light exposure step produces a curing reaction, then when the development process is carried out, the unexposed portion of the resist layer 104 is removed. In other words, in the development process, as shown in FIG. 5D, a resist 104*a* having an inversely tapered shape which is narrower at the transparent substrate 100 side and broader at the opposite side thereof is formed on the transparent substrate 100.

Figure 5E:
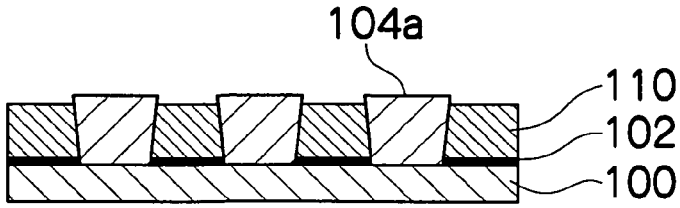

Next, in a metal layer forming step, a metal layer 110 is formed on the opaque metal film 102, as shown in FIG. 5E. The metal layer 110 is formed by using a commonly known electroforming method, and is made of nickel, or the like, for example.

Figure 5F:
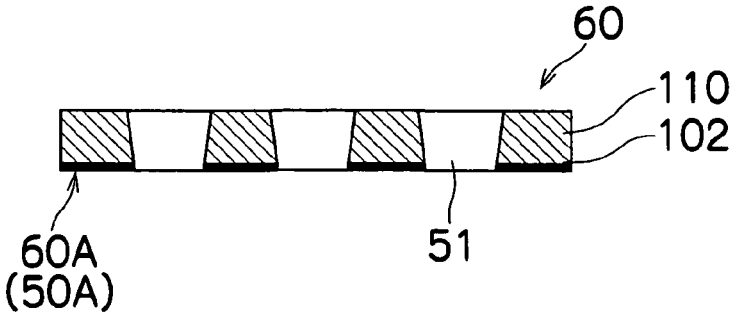

Next, in a separating step, as shown in FIG. 5F, the metal layer 110 and the opaque metal film 102 are separated from the transparent substrate 100 and the resist 104*a*. In the present embodiment, since the shape of the resist 104*a* is the inversely tapered shape (see FIG. 5E), the transparent substrate 100 is separated after the resist 104*a* is separated. Thus, it is possible to obtain a nozzle plate 60 having the metal layer 110 and the opaque metal film 102. Through holes (nozzles) 51 corresponding to the shapes of the inversely tapered resist 104*a* are formed in the nozzle plate 60.

There are no particular restrictions on the separation sequence of the transparent substrate 100 and the resist 104*a*, and it may be changed appropriately in accordance with the shape of the resist 104*a*, and the like. If the resist 104*a* has a substantially cylindrical shape with hardly any taper, then it is possible to separate the transparent substrate 100 and the resist 104*a* from the metal layer 110 and the opaque metal film 102 in a single action.

Moreover, according to requirements, it is also possible to remove the opaque metal film 102 from the metal layer 110 and to obtain a nozzle plate 60 consisting of the metal layer 110.

In general, in the resist layer forming step shown in FIG. 5B, the dimensional accuracy of the resist layer 104 formed on the transparent substrate 100 tends to decline as the resist layer becomes thicker. In the above-described third related method of manufacture, the thickness of the resist layer is 100 μm, and a dimensional accuracy in the resist layer of approximately ±10 μm is expected on the side that is not adjacent to the transparent substrate; whereas in the present embodiment, since the resist layer 104 has a small thickness of approximately 10 μm through 50 μm, then the dimensional accuracy in the resist layer 104 on the side that is not adjacent to the transparent substrate 100 will be approximately ±5 μm or less when the thickness of the resist layer 104 is 50 μm, and ±1 μm or less when the thickness of the resist layer 104 is 10 μm. In this way, in the present embodiment, it is possible to manufacture the nozzle plate 60 having excellent dimensional accuracy.

Further, the resist layer 104 has better dimensional accuracy at the side adjacent to the transparent substrate 100, compared to the side opposite from the transparent substrate 100. In the present embodiment, the surface of the opaque metal film 102 of the nozzle plate 60, in other words, the surface which makes contact with the transparent substrate 100 in FIG. 5E, is the surface of the nozzle plate 60 on the ink droplet ejection side (ink ejection surface) 60A, and this is a characteristic feature of the present embodiment. In this way, the dimensional accuracy of the nozzles 51 on the ink droplet ejection side is good, compared to the third related method of manufacture in which the surface on the opposite side to the transparent substrate forms the ink ejection surface.

Furthermore, in the present embodiment, the patterned opaque metal film 102 on the transparent substrate 100 functions as the mask in the light exposure step, and it has good dimensional accuracy, then the dimensional accuracy of the nozzles 51 formed through the subsequent developing step, metal layer forming step and separation step, is good.

In the present embodiment, since the ink ejection surface 60A of the nozzle plate 60 is made of the opaque metal film 102, it is then preferable that the opaque metal film 102 has liquid-repelling properties. Thereby, when ink mist generated as ink droplets are ejected from the nozzles 51 has adhered to the ink ejection surface 60A, then it can be removed readily by means of a blade or the like (not illustrated), and therefore, it is possible to prevent ejection errors in the nozzles 51 caused by ink mist adhering to the ink ejection surface 60A.

Figure 6:
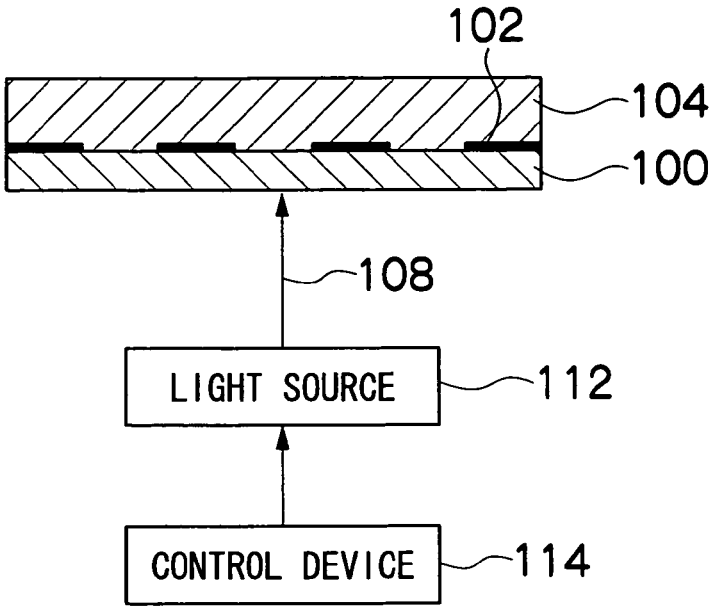
FIG. 6 is an illustrative diagram showing the characteristic portion of a light exposure step in the method of manufacturing a nozzle plate according to a second embodiment.
Figure 7:
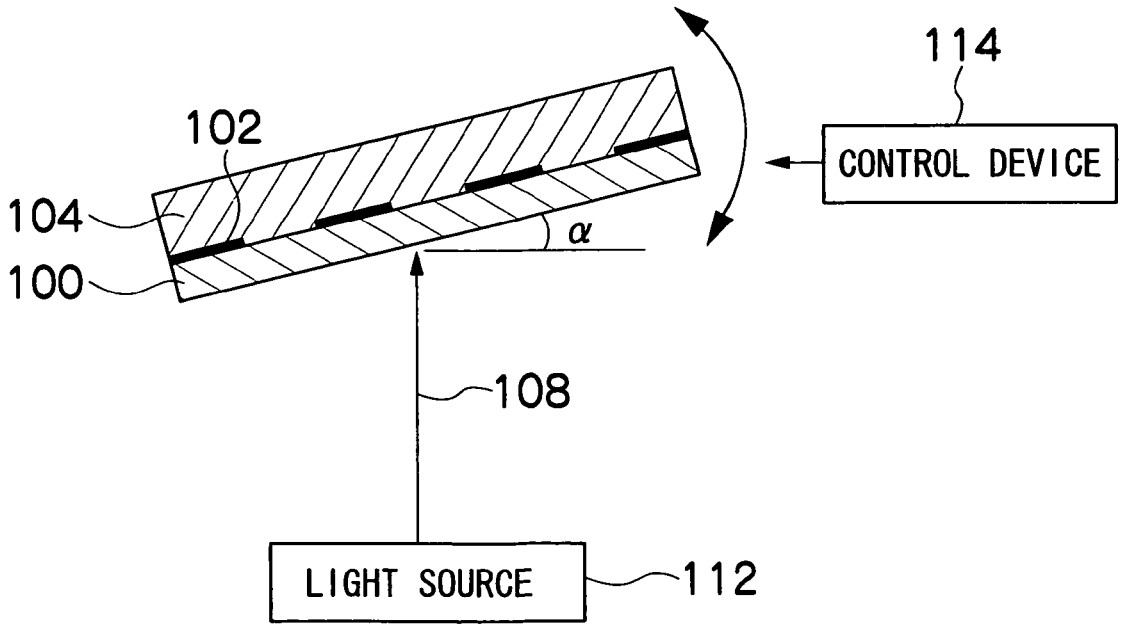
FIG. 7 is a modification example of FIG. 6.

FIG. 6 is an illustrative diagram showing the characteristic portion of a light exposure step in the method of manufacturing a nozzle according to a second embodiment of the present invention. FIG. 7 is a modification example of FIG. 6. The steps apart from the light exposure step are similar to those of the first embodiment and are therefore omitted from the drawings.

In the present embodiment, as shown in FIG. 6, the transparent substrate 100 and so on are disposed in a substantially perpendicular direction with respect to the direction of irradiation from a light source 112. The light source 112 emits the ultraviolet light 108 as parallel light, and is controlled by a control device 114. The control device 114 adjusts the wavelength range and light quantity of the ultraviolet light 108 emitted by the light source 112, and also adjusts the angle of irradiation, in accordance with the material of the resist layer 104, and the like. Accordingly, it is possible to form nozzles 51 having a desired tapered angle.

The control device 114 may control the resist layer 104 side in such a manner that the transparent substrate 100 forms a prescribed angle of a with respect to the direction of irradiation of the light source 112, as shown in FIG. 7. In this case also, it is possible to achieve similar beneficial effects to the case shown in FIG. 6.

Figure 8:
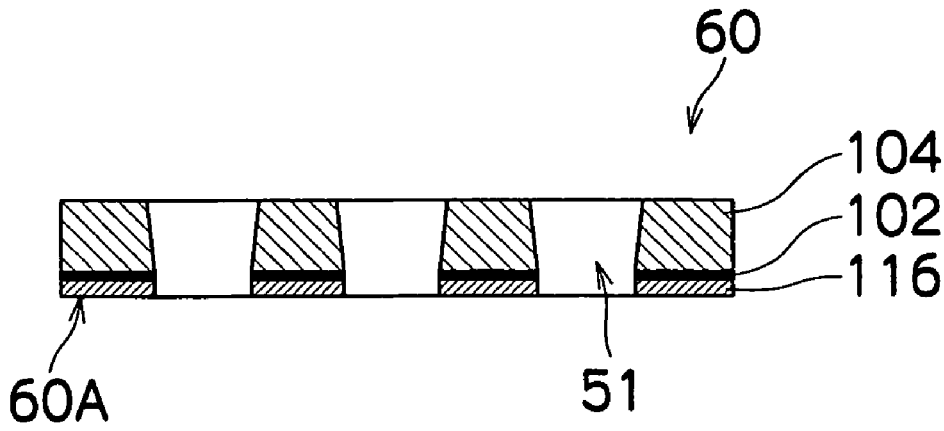
FIG. 8 is a side view cross-sectional diagram showing a nozzle plate according to a third embodiment.
Figure 9:
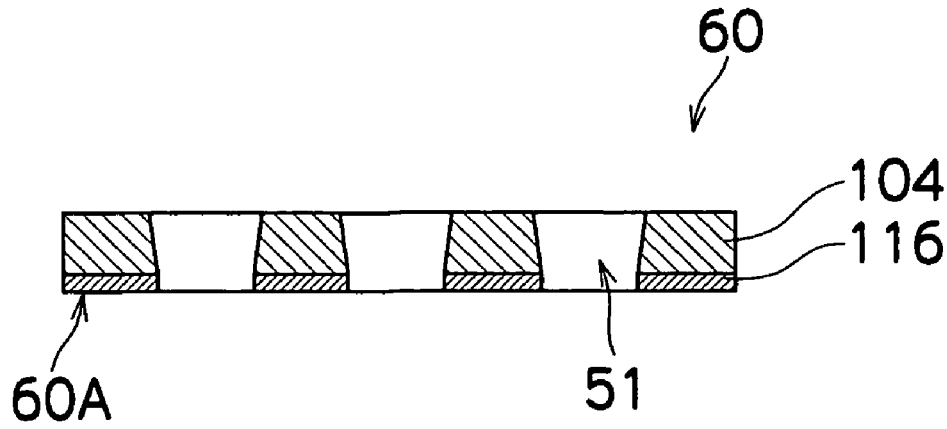
FIG. 9 is a modification example of FIG. 8.

FIG. 8 is a side view cross-sectional diagram showing a nozzle plate according to a third embodiment of the present invention. FIG. 9 is a modification example of FIG. 8.

In the present embodiment, as shown in FIG. 8, a liquid-repelling film 116 having liquid repellency is provided on the ink ejection surface 60A of the nozzle plate 60. The method of manufacturing the nozzle plate 60 is carried out similarly to the first embodiment shown in FIGS. 5A to 5F, and after completing the separation step (see FIG. 5F), the liquid-repelling film 116 is formed on the surface of the opaque metal film 102.

It is also possible to form the liquid-repelling film 116 on the surface of the metal layer 104 as shown in FIG. 9, after removing the opaque metal film 102 and the metal substrate 100 in the separation step shown in FIG. 5F.

By means of the liquid-repelling film 116 formed on the ink ejection surface 60A of the nozzle plate 60, even if the ink mist generated as ink is ejected becomes attached to the ink ejection surface 60A, this ink mist can be removed readily by means of a blade, or the like, and therefore it is possible to prevent ejection errors in the nozzles 51 caused by soiling, or the like, on the ink ejection surface 60A.

Although not shown in the drawings, it is also possible to compose the opaque metal film 102 in such a manner that it has liquid repellency, and in this case, the step of forming the liquid-repelling film 114 shown in FIGS. 8 and 9 can be omitted, and the efficiency of the manufacture can be improved.

Figure 10A:
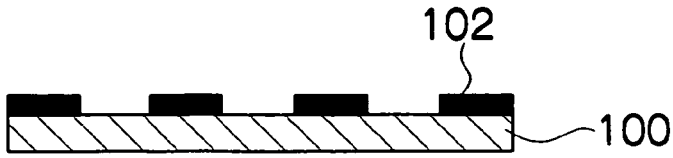
FIGS. 10A to 10F are illustrative diagrams showing steps of manufacturing a nozzle plate according to a fourth embodiment.
Figure 10B:
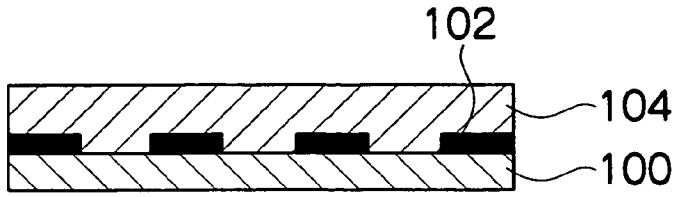
Figure 10C:
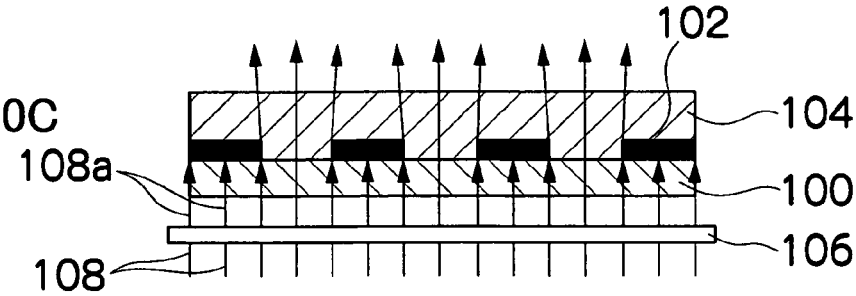
Figure 10D:
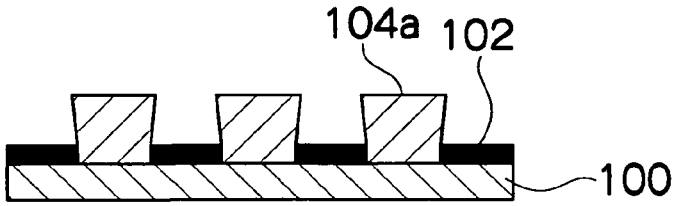
Figure 10E:
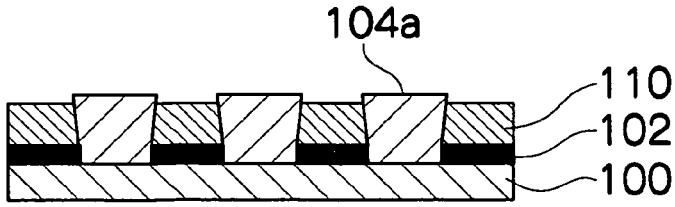
Figure 10F:
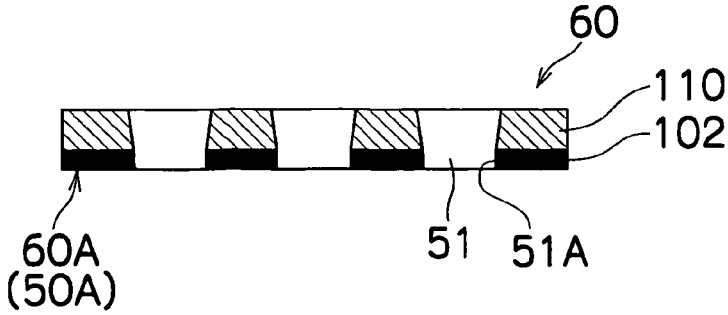
Figure 11A:
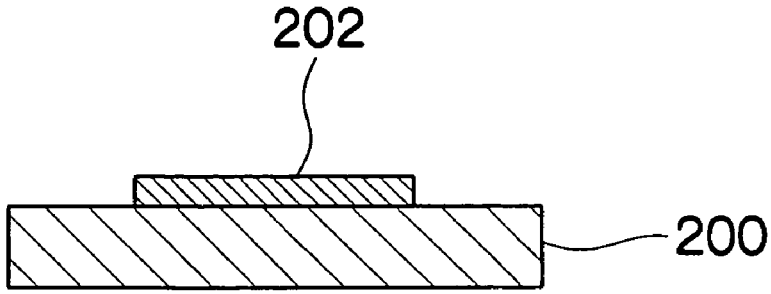
FIGS. 11A to 11C are illustrative diagrams showing a first related method of manufacture.
Figure 11B:
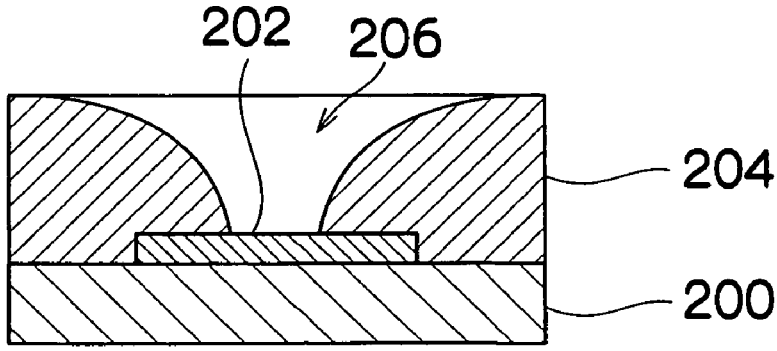
Figure 11C:
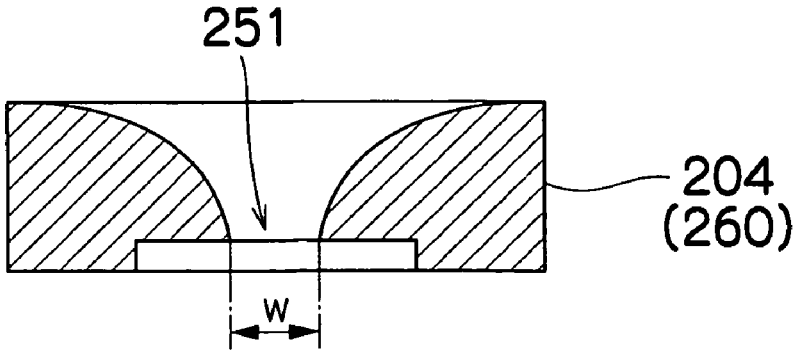
Figure 12A:
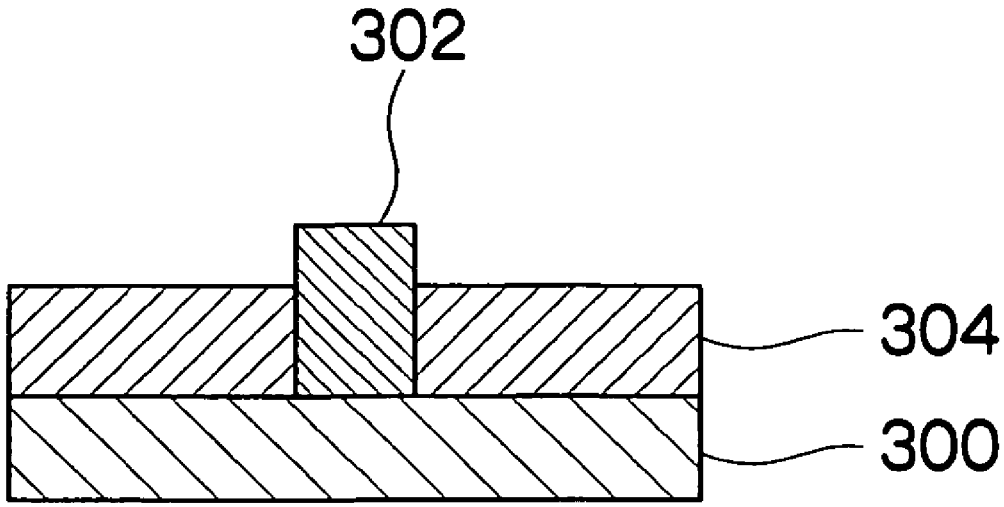
FIGS. 12A and 12B are illustrative diagrams showing a second related method of manufacture.
Figure 12B:
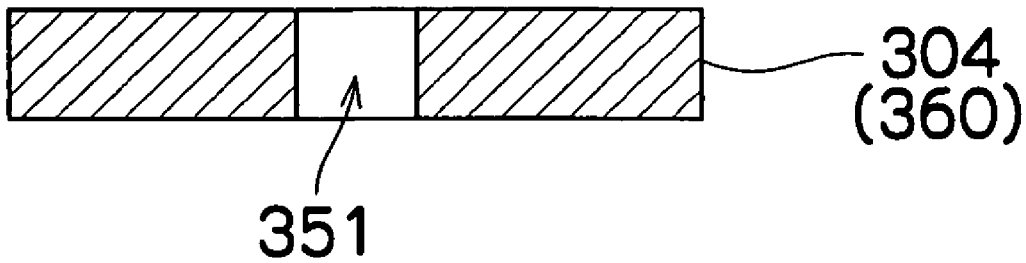
Figure 13A:
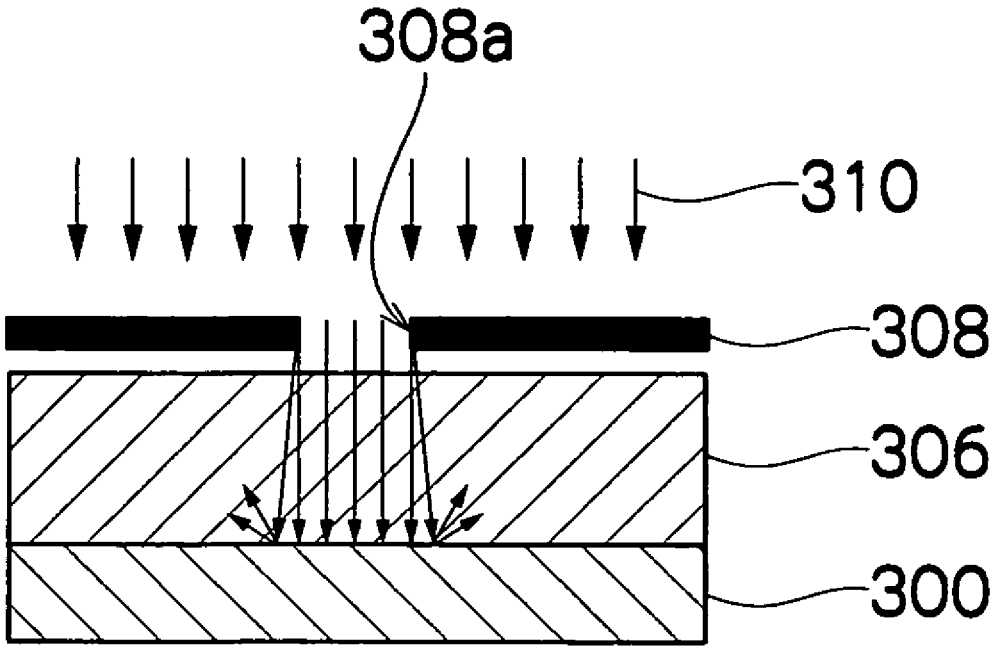
FIGS. 13A and 13B are illustrative diagrams showing problems in the second related method of manufacture.
Figure 13B:
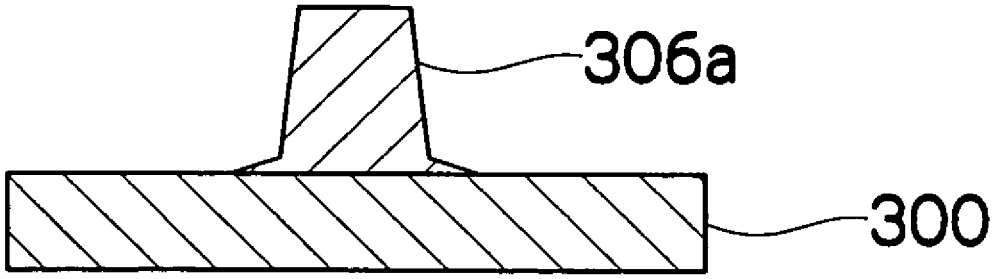

FIGS. 10A to 10F are illustrative diagrams showing steps of manufacturing a nozzle plate according to the fourth embodiment. The fourth embodiment is a mode in which the thickness of the opaque metal film 102 formed on the transparent substrate 100 in the step shown in FIG. 10A is not less than 1 μm and not more than 5 μm. In the nozzle plate 60 manufactured by using the opaque metal film 102 of this kind, straight portions 51A of a height (depth) corresponding to the thickness of the opaque metal film 102 are formed in the nozzles 51 on the side adjacent to the ink ejection surface 60A as shown in FIG. 10F, and therefore the ejection direction is stabilized.

If the thickness of the opaque metal film 102 is smaller than 1 μm, as in the first embodiment, then the straight portions 51A cannot function and there is little contribution to the stability of the ejection direction. On the other hand, if the thickness of the opaque metal film 102 is greater than 5 μm, then there is significant dimensional variation during patterning, which will have an adverse effect on the ink ejection volume and the ejection speed at the nozzles 51. Moreover, if the height (depth) of the straight portions 51A is large, then the fluid resistance increases, and hence ejection efficiency declines. Consequently, it is desirable that the thickness of the opaque metal film 102 is equal to or greater than 1 μm and equal to or less than 5 μm, as in the present embodiment.

The resist layer 104 in the present embodiment has the same thickness with the first embodiment (approximately 10 μm through 50 μm). Furthermore, as in the third embodiment, it is also possible to form a liquid-repelling film on the surface of the opaque metal film 102 after the step in FIG. 10F. Since the remaining steps are common to those of the first embodiment (see FIGS. 5A to 5F), then the same reference numerals are applied and description thereof is omitted here.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a nozzle plate formed with nozzles which eject liquid droplets, the method comprising the steps of:

forming and patterning an opaque metal film onto a transparent substrate;

forming photosensitive resin over the opaque metal film and the transparent substrate;

exposing the photosensitive resin to light from a side adjacent to the transparent substrate;

developing the photosensitive resin which has been exposed to the light;

forming a metal layer on the opaque metal film after the developing step; and separating at least the transparent substrate from the opaque metal film, wherein the nozzle plate comprises at least the metal layer, and a liquid droplet ejection surface of the nozzle plate is on a side where the transparent substrate has been separated in the separating step.

2. The method as defined in claim 1, wherein the exposing step comprises controlling a wavelength range of the light, an amount of the light and an irradiation angle of the light to the photosensitive resin, in such a manner that the light divergently travels through the photosensitive resin.

3. The method as defined in claim 1, wherein the photosensitive resin is of 10 μm through 50 μm in thickness.

4. The method as defined in claim 1, wherein the exposing step comprises controlling a wavelength range of the light.

5. The method as defined in claim 1, wherein the exposing step comprises controlling an amount of the light.

6. The method as defined in claim 1, wherein the exposing step comprises controlling an irradiation angle of the light to the photosensitive resin in such a manner that the light divergently travels through the photosensitive resin.

7. The method as defined in claim 1, wherein the photosensitive resin is separated from the opaque metal film simultaneously with the transparent substrate.

8. The method as defined in claim 1, wherein the nozzle plate further comprises the opaque metal film, and the liquid droplet ejection surface on the nozzle plate is a surface of the opaque metal film.

9. The method as defined in claim 8, wherein the opaque metal film has liquid repellency.

10. The method as defined in claim 8, wherein the opaque metal film is of not less than 1 μm and not more than 5 μm in thickness.

11. The method as defined in claim 1, further comprising:

separating the opaque metal film from the metal layer, wherein the nozzle plate comprises the metal layer, and the liquid droplet ejection surface of the nozzle plate is a surface of the metal layer.

* * * * *